US008086120B2

(12) United States Patent
Thayer et al.

(10) Patent No.: US 8,086,120 B2
(45) Date of Patent: Dec. 27, 2011

(54) METHOD AND APPARATUS FOR PREDICTING BLADE LIFE IN AN IMAGE PRODUCTION DEVICE

(75) Inventors: Bruce Earl Thayer, Webster, NY (US); Aaron Michael Burry, Ontario, NY (US); Michael F. Zona, Holley, NY (US)

(73) Assignee: Xerox Corporation, Norwalk, CT (US)

( * ) Notice: Subject to any disclaimer, the term of this patent is extended or adjusted under 35 U.S.C. 154(b) by 341 days.

(21) Appl. No.: 12/480,835

(22) Filed: Jun. 9, 2009

(65) Prior Publication Data

US 2010/0310263 A1 Dec. 9, 2010

(51) Int. Cl.
*G03G 21/00* (2006.01)

(52) U.S. Cl. ..... 399/34; 399/350

(58) Field of Classification Search ..... 399/34, 399/327, 343, 350

See application file for complete search history.

(56) References Cited

U.S. PATENT DOCUMENTS 7,283,781 B2 10/2007 Thayer
2009/0110416 A1* 4/2009 Thayer et al. ..... 399/34

FOREIGN PATENT DOCUMENTS

JP 2006267974 A * 10/2006

* cited by examiner

*Primary Examiner* — David Gray
*Assistant Examiner* — Billy J Lactaoen
(74) *Attorney, Agent, or Firm* — Ronald E. Prass, Jr.; Prass LLP

(57) ABSTRACT

A method and apparatus for predicting blade life in an image production device is disclosed. The method may include retrieving a number of print starts, a number of print cycles, a wear rate for print starts, and a wear rate for print cycles from a memory, calculating wear of a cleaning blade based on the number of print starts, the number of print cycles, the wear rate for print starts, and the wear rate for print cycles, wherein the wear rate for print starts and the wear rate for print cycles are weighed differently, determining if the calculated wear of the cleaning blade exceeds a predetermined threshold, wherein if it is determined that the calculated wear of the cleaning blade exceeds a predetermined threshold, sending a notification that the cleaning blade needs to be replaced.

21 Claims, 4 Drawing Sheets

METHOD AND APPARATUS FOR PREDICTING BLADE LIFE IN AN IMAGE PRODUCTION DEVICE

BACKGROUND

Disclosed herein is a method for predicting blade life in an image production device, as well as corresponding apparatus and computer-readable medium.

In electrostatographic printing with dry marking material generally referred to as xerography), an electrostatic latent image is created on a charge-retentive surface, such as an image receptor, photoreceptor or other charge receptor, and the latent image is developed by exposing it to a supply of toner particles, which are attracted as needed to appropriately-charged areas of the latent image. The toner particles are then transferred in image-wise fashion from the image receptor to a print sheet, the print sheet being subsequently heated to permanently fuse the toner particles thereto to form a durable image.

Following the transfer of the image from the image receptor to the print sheet, residual toner particles remaining on the image receptor are removed or cleaned by any number of known means, such as including a cleaning blade, brush, and/or vacuum. In a typical embodiment, the removed residual toner is then collected directly into a hopper, from where it is then removed, typically for example by means of an auger, into a waste container.

The life of a cleaning blade (or "blade life") has traditionally been determined from a failure distribution generated by collecting life data from numerous blades run under actual field or field representative conditions. When sufficient data has been collected to have confidence in the failure distribution, blade life is determined by selecting an acceptable failure percentage for the distribution. If failure of 10% of the blade population is acceptable, the end of use point for each blade in the population is found from the cumulative probability of failure distribution where 90% of the blades survive.

The problem with such a method for determining the end of blade life point is that different stress levels influence how long an individual blade will survive. If stress information is available for individual blades then life predictions for individual blade blades can be made. If blades are replaced based on actual usage stress, then the blade life distribution for the entire population will shift to longer lives and fewer failures. More of the lightly stressed blades will be run closer to their individual failure points and more of the highly stressed blades will be replaced before they fail.

SUMMARY

A method and apparatus for predicting blade life in an image production device is disclosed. The method may include retrieving a number of print starts, a number of print cycles, a wear rate for print starts, and a wear rate for print cycles from a memory, calculating wear of a cleaning blade based on the number of print starts, the number of print cycles, the wear rate for print starts, and the wear rate for print cycles, wherein the wear rate for print starts and the wear rate for print cycles are weighed differently, determining if the calculated wear of the cleaning blade exceeds a predetermined threshold, wherein if it is determined that the calculated wear of the cleaning blade exceeds a predetermined threshold, sending a notification that the cleaning blade needs to be replaced.

DETAILED DESCRIPTION

Figure 1:
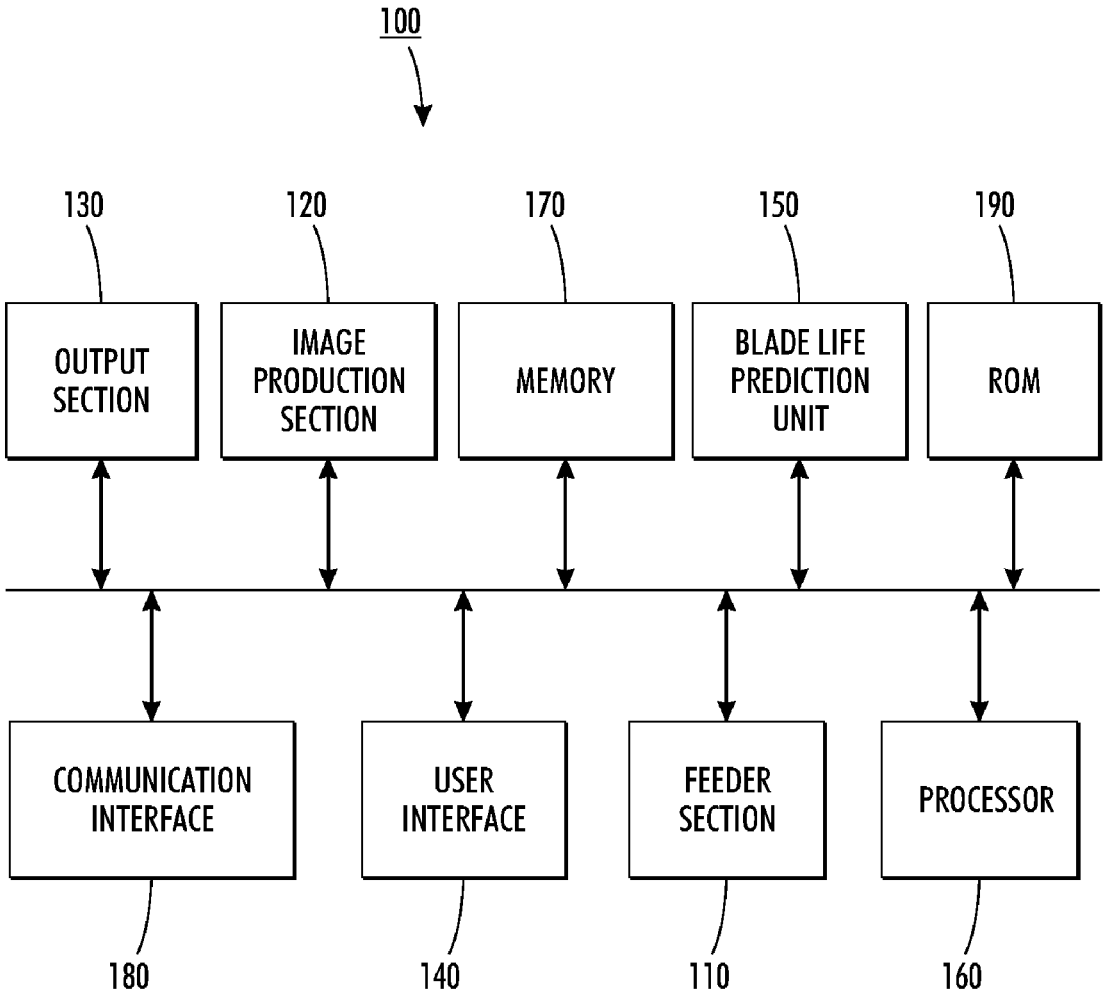
FIG. 1 is an exemplary block diagram of an image production device in accordance with one possible embodiment of the disclosure.

Aspects of the embodiments disclosed herein relate to a method for predicting blade life in an image production device, as well as corresponding apparatus and computer-readable medium.

The disclosed embodiments may include a method for predicting blade life in an image production device. The method may include retrieving a number of print starts, a number of print cycles, a wear rate for print starts, and a wear rate for print cycles from a memory, calculating wear of a cleaning blade based on the number of print starts, the number of print cycles, the wear rate for print starts, and the wear rate for print cycles, wherein the wear rate for print starts and the wear rate for print cycles are weighed differently, determining if the calculated wear of the cleaning blade exceeds a predetermined threshold, wherein if it is determined that the calculated wear of the cleaning blade exceeds a predetermined threshold, sending a notification that the cleaning blade needs to be replaced.

The disclosed embodiments may further include an image production device that may include a memory, a cleaning blade, and a blade life prediction unit that retrieves a number of print starts, a number of print cycles, a wear rate for print starts, and a wear rate for print cycles from the memory, calculates wear of the cleaning blade based on the number of print starts, the number of print cycles, the wear rate for print starts, and the wear rate for print cycles from a memory, determines if the calculated wear of the cleaning blade exceeds a predetermined threshold, wherein if the blade life prediction unit determines that the calculated wear of the cleaning blade exceeds a predetermined threshold, the blade life prediction unit sends a notification that the cleaning blade needs to be replaced, wherein the wear rate for print starts and the wear rate for print cycles are weighed differently.

The disclosed embodiments may further include a computer-readable medium storing instructions for controlling a computing device for predicting blade life in an image production device. The instructions may include retrieving a number of print starts, a number of print cycles, a wear rate for print starts, and a wear rate for print cycles from a memory, calculating wear of a cleaning blade based on the number of print starts, the number of print cycles, the wear rate for print starts, and the wear rate for print cycles, wherein the wear rate for print starts and the wear rate for print cycles are weighed differently, determining if the calculated wear of the cleaning blade exceeds a predetermined threshold, wherein if it is determined that the calculated wear of the cleaning blade exceeds a predetermined threshold, sending a notification that the cleaning blade needs to be replaced.

The disclosed embodiments may concern a method and apparatus for predicting blade life in an image production device. The process may predict life for individual blades based on the total length of blade travel (e.g., image receptor or print cycles) and the number of starts the blade has made (e.g., number of jobs without cycle-out). A higher stress may be imparted to the blade at start-up as the surface it is sliding on accelerates from a stand still to operating speed. A lower stress may be imparted to the blade after the surface is at running speed. Blade failure may be predicted when the sum of a high stress factor times the number of starts plus a low stress factor times the number of cycles is equals or exceeds a failure threshold value. The blade may be replaced when the sum reaches or exceeds a replacement threshold, equal to a percentage of the failure threshold. The replacement threshold may be chosen based on confidence in the two stress factors and tolerance for blade failures.

Strain gages mounted near the tip of cleaning blades have shown that a high strain is experienced by the blade as the cleaning surface begins to move. After the cleaning surface has reached its operating speed, the blade strain drops to a relatively constant, lower strain level. A high strain at start-up is not unexpected. Breaking static friction at start-up and stick-slip motion of the blade tip at slow speeds contribute to high strain.

Wear on an individual blade in a machine may then be predicted by summing the blade wear accumulated due to start-up and the wear accumulated while running. Counters in the machine controller need to keep track of the total amount of blade sliding, e.g., image receptor or print cycles, and the total number of machine starts, e.g., cycle-ups. The predicted wear may be calculated as shown below.

$$\text{Wear}=WR_{start}N_{starts}+WR_{run}N_{cycles}$$

Accumulated running, e.g., prints or cycles, may be commonly stored in NVM. If not currently recorded, the number of starts may easily be added to the machine control processes.

The start-up and running wear rates may best be determined through machine testing under various environmental, print and lubrication conditions. Additional prediction accuracy may be obtained by including environmental, print and lubrication influences in the start-up and running wear rates. Printing machines that sense these conditions may then use this additional information to refine the start-up and running wear rates accordingly. Because the start-up wear rate is very much larger than the running wear rate (24 times in the example above), the refinements due to operating conditions may probably be only secondary improvements to the wear predictions made using only cycle and start counts.

To predict when the blade will fail, a failure threshold wear value may be needed. This value may be easily be found by measuring wear on blades that are failing or checking for failure on blades with known amounts of wear. In the case of photoreceptor cleaning blades, the failure may be visible on the photoreceptor and/or the prints. Photoreceptor cleaning failures may show first as toner past the blade and only later, when more wear has accumulated, on the print. The wear failure threshold may be used to determine when to replace a blade by comparing it to the predicted wear at a predetermined percent of the cumulative probability of wear. For example, if 90% cumulative probability is chosen, then 10% of the wear distribution will be greater than the wear failure threshold. A more conservative approach may use a greater cumulative probability. For photoreceptor cleaning blades, 90% cumulative probability may be reasonable because the 10% of the blade wear greater than the threshold may be seldom localized enough to generate defects on prints. The cumulative probability chosen may reflect the percentage of blade failures that may be acceptable in the machine being considered. Higher cumulative probabilities may result in more blade replacements and fewer blade failures. As a result, there may be a trade off between the cost of more frequent blade replacements and the cost of more blade failures.

Predicting blade life based on individual use conditions provides an advantage over the conventional method of replacement at a predetermined number of prints or cycles. The predetermined replacement number may be chosen to avoid too many failures from blades operating at the high stress end of the life distribution. Most of the blade population may be operating at much lower levels of stress and can successfully operate for much longer before failure. The life prediction method described in the disclosed embodiments may increase blade life of the population by allowing low stress blades to run longer and decreases the number of failures by replacing high stress blades prior to failure.

The typical service strategy for blade architectures is to have a fixed replacement interval by designating the blade or xerographic module as a high frequency service item (HFSI) that drives when the blade/module gets replaced. By understanding how the customer has used their machine (i.e. high stress jobs vs. low stress jobs) and calculating imminent blade failure, the fixed interval may be replaced by the actual failure distribution of the blade. For customers running in high stress conditions, the blade may be replaced prior to seeing cleaning defects, which helps customer satisfaction. For customers running low stress conditions, the blade may be replaced much less frequently, which lowers the system run cost.

Additionally, having the threshold calculation being done using variables in NVM, future improvements that may occur to the design on the blade or xerographic module hardware may be incorporated through updated processes or NVM updates. For example, if a new photoreceptor surface or blade material is developed that greatly improves the blade edge wear, a slight modification to the threshold wear NVM location by process upgrade, remote service adjustment, etc.) may allow current machines in the field to accept the new technology and still operate using the new hardware's failure distribution as described in the embodiments.

FIG. 1 is an exemplary block diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example. The image production device 100 may include a bus 105, a feeder section 110, an image production section 120, an output section 130, a user interface 140, a blade life prediction unit 150, a user interface 150, a processor 160, a memory 170, a communication interface 380, and a read only memory (ROM) 190. Bus 105 may permit communication among the components of the image production device 100.

The image production section 120 may include hardware by which image signals are used to create a desired image, the feeder section 110 may store and dispenses sheets on which images are to be printed, and the output section 130 may include hardware for stacking, folding, stapling, binding, etc., prints which are output from the marking engine. If the printer is also operable as a copier, the printer further includes a document feeder as part of the feeder section, which operates to convert signals from light reflected from original hard-copy image into digital signals, which are in turn processed to create copies with the image production section 120. The image production device 100 may also include a local user interface 140 for controlling its operations, although another source of image data and instructions may include any number of computers to which the printer is connected via a network. The user interface 140 may include a keyboard, a display, a mouse, a pen, a voice recognition device, touchpad, buttons, etc., for example.

With reference to feeder section 110, the module includes any number of trays, each of which stores a media stack or print sheets ("media") of a predetermined type (size, weight, color, coating, transparency, etc.) and includes a feeder to dispense one of the sheets therein as instructed. Certain types of media may require special handling in order to be dispensed properly. For example, heavier or larger media may desirably be drawn from a media stack by use of an air knife, fluffer, vacuum grip or other application of air pressure toward the top sheet or sheets in a media stack. The fluffer may blow air onto the edge of a media stack to create separation between the media sheets in order to avoid jamming of the image production device 100. Certain types of coated media are advantageously drawn from a media stack by the use of an application of heat, such as by a stream of hot air blown on the media stack using the fluffer, for example.

Once fluffed, the sheets of media drawn from a media stack on a selected tray may then be moved to the image production section 120 to receive one or more images thereon. Then, the printed sheet is then moved to output section 130, where it may be collated, stapled, folded, etc., with other media sheets in manners familiar in the art.

Processor 160 may include at least one conventional processor or microprocessor that interprets and executes instructions. Memory 170 may be a random access memory (RAM) or another type of dynamic storage device that stores information and instructions for execution by processor 160. Memory 170 may also include a read-only memory (ROM) which may include a conventional ROM device or another type of static storage device that stores static information and instructions for processor 160.

Communication interface 180 may include any mechanism that facilitates communication via a network. For example, communication interface 180 may include a modem. Alternatively, communication interface 180 may include other mechanisms for assisting in communications with other devices and/or systems.

ROM 190 may include a conventional ROM device or another type of static storage device that stores static information and instructions for processor 160. A storage device may augment the ROM 190 and may include any type of storage media, such as, for example, magnetic or optical recording media and its corresponding drive.

The image production device 100 may perform such functions in response to processor 160 by executing sequences of instructions contained in a computer-readable medium, such as, for example, memory 170. Such instructions may be read into memory 170 from another computer-readable medium, such as a storage device or from a separate device via communication interface 180.

The image production device 100 illustrated in FIG. 1 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

The operation of the blade life prediction unit 350 and blade life prediction process will be discussed below in relation to the flowchart in FIG. 3.

Figure 2:
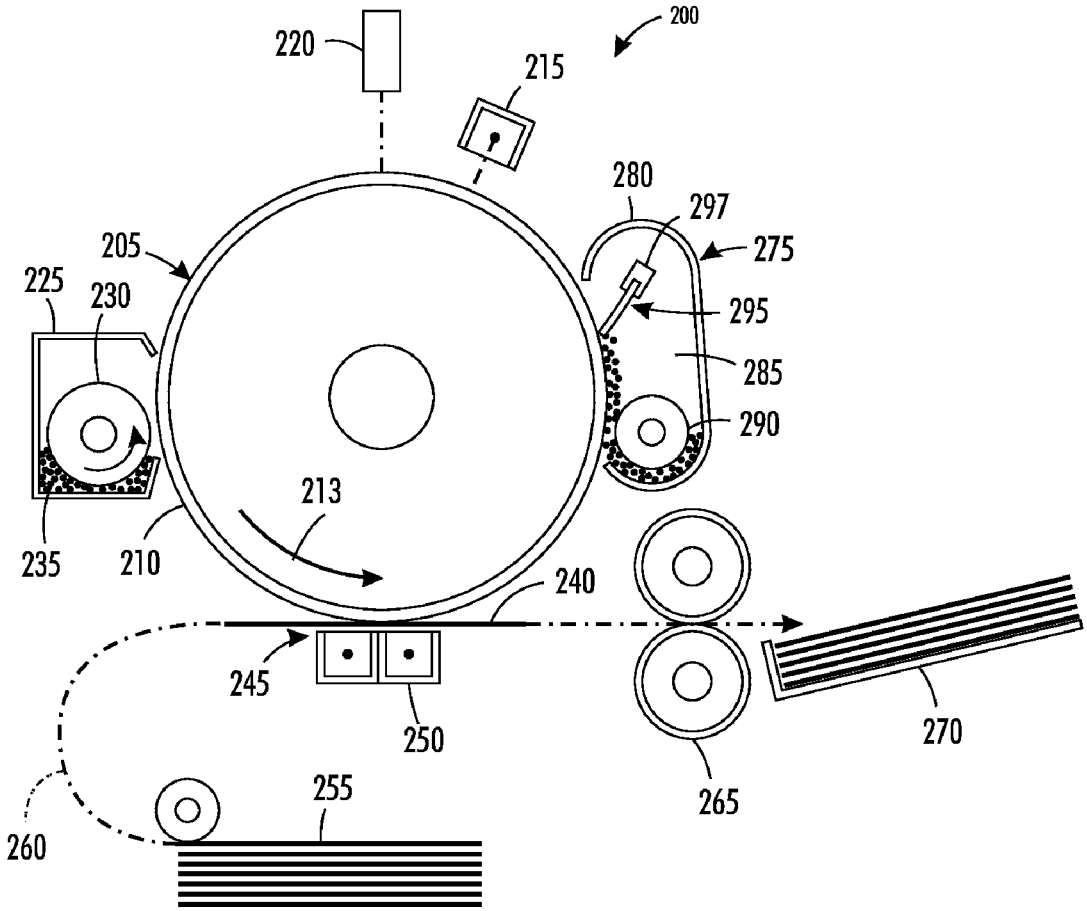
FIG. 2 is a diagram of an exemplary blade location in the image production device in accordance with one possible embodiment of the disclosure.

FIG. 2 is a diagram of an exemplary blade location 200 in the image production device 100 in accordance with one possible embodiment of the disclosure. While the exemplary blade location 200 is a simplified elevational view showing relevant elements of an electrostatographic or toner-imaging machine, the cleaning blade location 200 may be located in other image production devices 100 in accordance with the disclosed embodiments.

As is well known, an image receptor 205 (such as a photoreceptor (as shown) or other charge receptor) having an imageable surface 210 and rotatable in a direction 213 may be uniformly charged by a charging device 215 and image-wise exposed by an exposure device 220 to form an electrostatic latent image on the surface 210. The latent image may thereafter be developed by a development apparatus 225 that for example includes a developer roll 230 for applying a supply of charged toner particles 235 to such latent image. The developer roll 230 may be of any of various designs such as a magnetic brush roll or donor roll, as is familiar in the art. The charged toner particles 235 may adhere to appropriately charged areas of the latent image. The surface of image receptor 205 may then move, as shown by the arrow 213, to a transfer zone 245. Simultaneously, a print sheet 240 on which a desired image is to be printed may be drawn from a sheet supply stack 255 and conveyed along a sheet path 260 to the transfer zone 245.

At the transfer zone 245, the print sheet 240 may be brought into contact or at least proximity with the surface 210 of image receptor 205, which at this point is carrying toner particles thereon. A corotron or other charge source 250 at transfer zone 245 may cause the toner image on image receptor 205 to be electrostatically transferred to the print sheet 240. The print sheet 240 may then be forwarded to subsequent stations, as is familiar in the art, such as a fuser station 265, and then to an output tray 220.

Following such transfer of a toner image from the surface 210 to the print sheet 240, any residual toner particles remaining on the surface 210 may be removed by a toner image bearing surface cleaning apparatus 275 that may include for example a cleaning blade 295 and blade holder 297. As shown, the toner image bearing surface cleaning apparatus 275 may have a housing 280 that defines a chamber 285 that may include the cleaning blade 295 and blade holder 297. The cleaning blade 295 and blade holder 297 may be mounted within the chamber 285 for scraping the moving surface 210 and removing residual toner particles therefrom. The cleaning apparatus 275 may also include an auger device 290 for discharging residual toner particles from the housing 280.

In this example, the cleaning blade 295 is shown to be a photoreceptor cleaning blade. However, the blade life prediction process may be applied to any cleaning blade 295 in any image production device 100. Furthermore, the cleaning blade 295 may be part of a cartridge that may permit easy installation and replacement.

Although the image receptor 205 is shown as a xerographic photoreceptor in the drawings and description, the image receptor 205 may also be an intermediate drum used in solid-ink-jet printing; an intermediate belt or drum used in color xerography; an offset member used in offset printing; or any member in which ink, toner, or other colorant is temporarily retained for transfer onto another member or a media sheet and is cleaned using cleaning blades 295.

Figure 3:
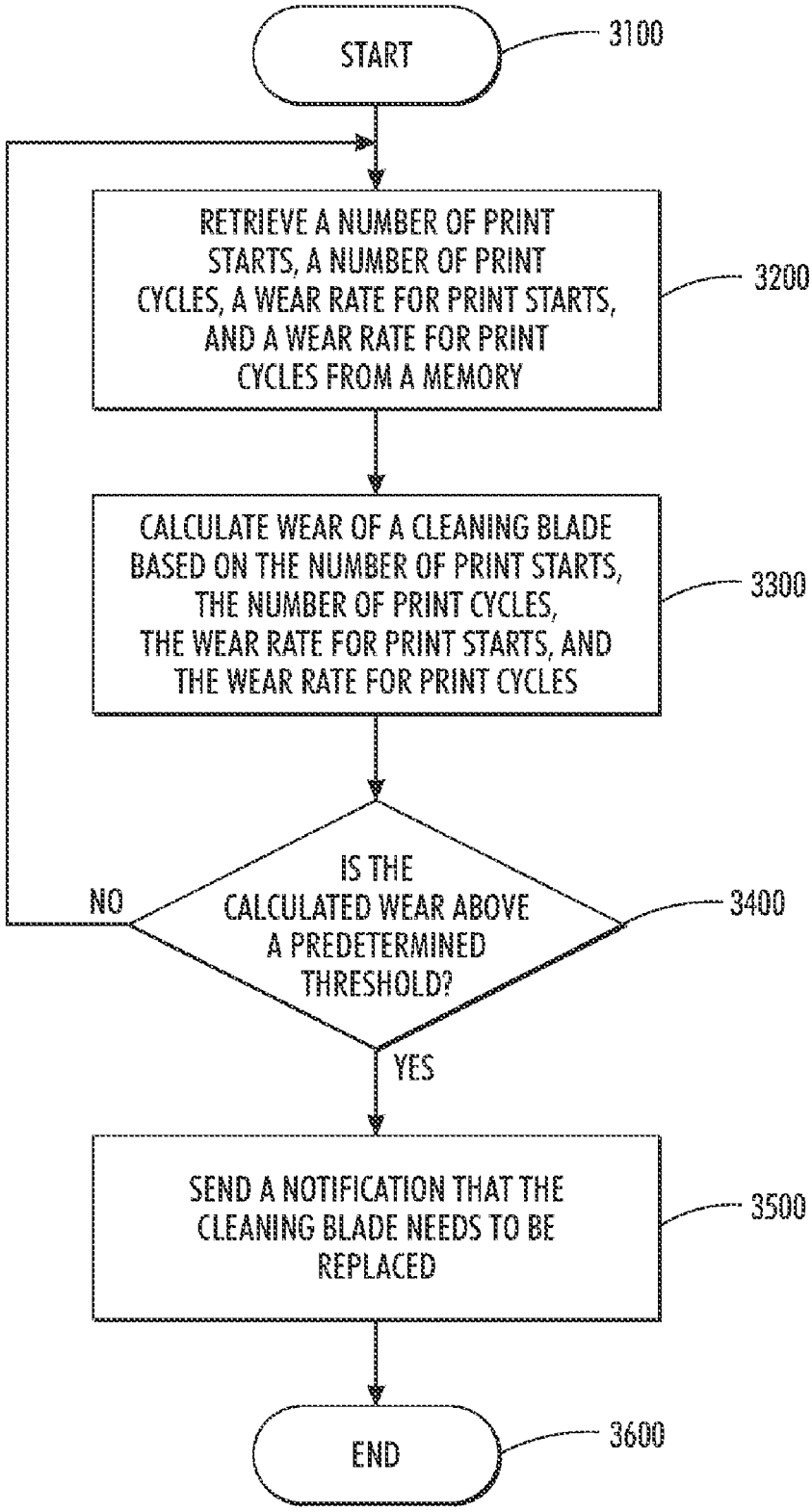
FIG. 3 is a flowchart of an exemplary blade life prediction process in accordance with one possible embodiment of the disclosure.

FIG. 3 is a flowchart of a possible blade life prediction process in accordance with one possible embodiment of the disclosure. The process may begin at step 3100, and continues to step 3200 where the blade life prediction unit 150 may retrieve a number of print starts, a number of print (e.g., image receptor, photoreceptor, etc.) cycles, a wear rate for print starts, and a wear rate for print cycles from a memory 170.

At step 3300, the blade life prediction unit 150 may calculate wear of the cleaning blade 295 based on the number of print starts, the number of print cycles, the wear rate for print starts, and the wear rate for print cycles. The blade life prediction unit 150 may calculate the wear of a cleaning blade using the formula $Wear=WR_{start}N_{starts}+WR_{run}N_{cycles}$, for example, where $WR_{start}$=blade wear rate of starts, $WR_{run}$=blade wear rate of print cycles, $N_{start}$=number of starts, and $N_{cycles}$=number of print cycles. The blade wear rate of starts ($WR_{start}$) may be greater than the blade wear rate of print cycles ($WR_{run}$). The cleaning blade 295 may be any cleaning blade in the image production device 100, such as an image receptor or photoreceptor cleaning blade, for example.

At step 3400, the blade life prediction unit 150 may determine if the calculated wear of the cleaning blade 295 exceeds a predetermined threshold. If the blade life prediction unit 150 determines that the calculated wear of the cleaning blade 295 does not exceed a predetermined threshold, the process returns to step 3200.

If at step 3400, the blade life prediction unit 150 determines that the calculated wear of the cleaning blade 295 exceeds a predetermined threshold, the process then goes to step 3500 where the blade life prediction unit 150 sends a notification that the cleaning blade 295 needs to be replaced. In this manner, the blade life prediction unit 150 may send the notification to a user interface, a computer, a server, a telephone, or a remote maintainer, for example. At step 3600, the process may go to step 4600 and end.

Note that there may be more than one predetermined threshold, such that if the blade life prediction unit 150 determines that the calculated wear of the cleaning blade exceeds a warning predetermined threshold, the blade life prediction unit 150 may send a warning notification that the cleaning blade needs to be replaced in the near future, for example.

Figure 4:
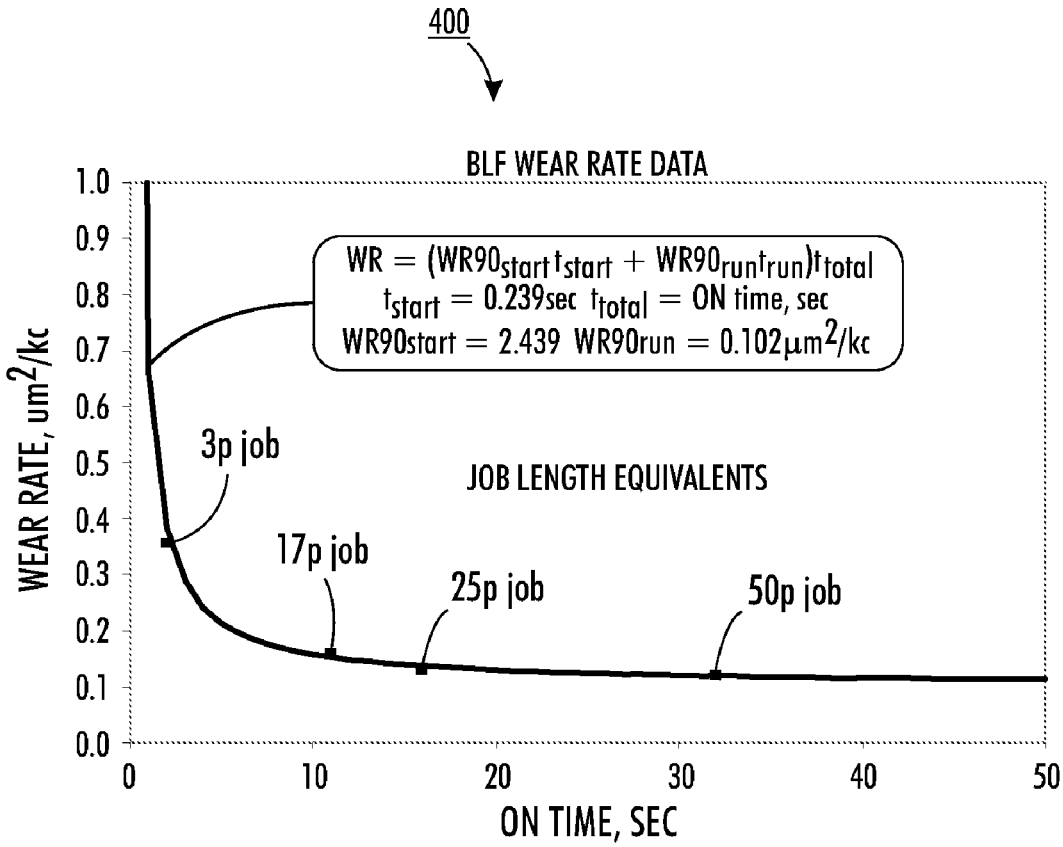
FIG. 4 is an exemplary graph illustrating the blade life fixture wear rate data in accordance with one possible embodiment of the disclosure.

FIG. 4 is an exemplary graph 400 illustrating the blade life fixture wear rate data in accordance with one possible embodiment of the disclosure. It was hypothesized that the high strains at start-up could significantly contribute to wear of the blade tip.

In order to test this hypothesis, blades were run in the Blade Life Fixtures (BLF) at the same process speed, for the same number of cycles, but with varying numbers of start-stops. This was controlled by setting the on time of the fixture to varying values (1, 2, 11, 16, 32 sec). By assuming a common print length, an approximate job length in prints was calculated for each on time. The time the fixture was off between run (on) cycles was set to maintain the fixtures for each on time setting at the same temperature. This process may prevent any heat buildup during long runs from influencing blade material properties and strengths.

As hypothesized, blades run with more starts experienced higher wear than blades run with fewer starts. The graph 400 shows the wear rates of blades tested with equivalent job lengths of 2, 17, 25, and 50 prints/job, where the machine cycles out and stops between each job. The curve drawn through the data points is generated from a simple model for average wear rate. The process may assume that average wear rate is determined from a higher wear rate during start-up and lower wear rate when the surface has reached operating speed, according to the following equation:

$$WR_{average} = \frac{WR_{start}t_{start} + WR_{run}t_{run}}{t_{start} + t_{run}}$$

For the three larger on time data points shown in the graph 400, the start-up wear rate was 2.439 $\mu m^2$/kc and the running wear rate was 0.102 $\mu m^2$/kc. The wear rates are at the 90% point on the cumulative probability distribution of blade wear. This means that only 10% of the blade wear is higher than this value. The start-up time was 0.239 seconds for a process speed of 406 mm/sec. The on time plotted in the graph 400 is the sum of the start-up time, $t_{start}$, and the running time, $t_{run}$. The average wear rate prediction curve was then plotted using these values in the equation above. The lowest on time data point was then plotted after the prediction curve had been drawn. As seen in the graph 400, the wear rate for the 3 print/job test fell very close to the predicted curve.

This test confirms that blade wear increases when more starts (shorter job lengths) are experienced. This result is similar to the common understanding that longer jobs result in longer component lives due to improved cyclic efficiency. This, however, is not an improvement due to cyclic efficiency. The cause is the higher strain on the blade tip at slow speeds during start-up. Even if the machine were operating at 100% efficiency (i.e. every cycle was used for making customer prints), the increased wear effect at shorter jobs lengths shown in the data of the graph 400 would occur.

This result can be very useful as a predictor of the life of an individual blade in a machine. Testing such as described above can be used to determine the higher blade wear rate during start-up and the lower wear rate while running at operational speed.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for predicting blade life in an image production device, comprising:

retrieving a number of print starts, a number of print cycles, a wear rate for print starts, and a wear rate for print cycles from a memory;

calculating wear of a cleaning blade based on the number of print starts, the number of print cycles, the wear rate for print starts, and the wear rate for print cycles, wherein the wear rate for print starts and the wear rate for print cycles are weighed differently;

determining if the calculated wear of the cleaning blade exceeds a predetermined threshold, wherein if it is determined that the calculated wear of the cleaning blade exceeds a predetermined threshold, sending a notification that the cleaning blade needs to be replaced.

2. The method of claim 1, wherein the wear of the cleaning blade is calculated using the formula $Wear=WR_{start}N_{starts}+WR_{run}N_{cycles}$, where $WR_{start}$=blade wear rate of starts, $WR_{run}$=blade wear rate of print cycles, $N_{start}$=number of starts, and $N_{cycles}$=number of print cycles.

3. The method of claim 2, wherein the blade wear rate of starts ($WR_{start}$) is greater than the blade wear rate of print cycles ($WR_{run}$).

4. The method of claim 1, wherein the notification is sent to at least one of a user interface, a computer, a server, a telephone, and a remote maintainer.

5. The method of claim 1, wherein if it is determined that the calculated wear of the cleaning blade exceeds a warning predetermined threshold, sending a warning notification that the cleaning blade needs to be replaced in the near future.

6. The method of claim 1, wherein the cleaning blade is one of a photoreceptor cleaning blade, an intermediate belt cleaning blade, and a solid inkjet drum maintenance blade.

7. The method of claim 1, wherein the image production device is one of a copier, a printer, a facsimile device, and a multi-function device.

8. An image production device, comprising:

a memory;

a cleaning blade; and a blade life prediction unit that retrieves a number of print starts, a number of print cycles, a wear rate for print starts, and a wear rate for print cycles from the memory, calculates wear of the cleaning blade based on the number of print starts, the number of print cycles, the wear rate for print starts, and the wear rate for print cycles from a memory, determines if the calculated wear of the cleaning blade exceeds a predetermined threshold, wherein if the blade life prediction unit determines that the calculated wear of the cleaning blade exceeds a predetermined threshold, the blade life prediction unit sends a notification that the cleaning blade needs to be replaced, wherein the wear rate for print starts and the wear rate for print cycles are weighed differently.

9. The image production device of claim 8, wherein the blade life prediction unit calculates wear of a cleaning blade using the formula $Wear=WR_{start}N_{starts}+WR_{run}N_{cycles}$, where $WR_{start}$=blade wear rate of starts, $WR_{run}$=blade wear rate of print cycles, $N_{start}$=number of starts, and $N_{cycles}$=number of print cycles.

10. The image production device of claim 9, wherein the blade wear rate of starts ($WR_{start}$) is greater than the blade wear rate of print cycles ($WR_{run}$).

11. The image production device of claim 8, wherein the blade life prediction unit sends the notification to at least one of a user interface, a computer, a server, a telephone, and a remote maintainer.

12. The image production device of claim 8, wherein if the blade life prediction unit determines that the calculated wear of the cleaning blade exceeds a warning predetermined threshold, the blade life prediction unit sends a warning notification that the cleaning blade needs to be replaced in the near future.

13. The image production device of claim 8, wherein the cleaning blade is one of a photoreceptor cleaning blade, an intermediate belt cleaning blade, and a solid inkjet drum maintenance blade.

14. The image production device of claim 8, wherein the image production device is one of a copier, a printer, a facsimile device, and a multi-function device.

15. A non-transitory computer-readable medium storing instructions for controlling a computing device for predicting blade life in an image production device, the instructions comprising:

retrieving a number of print starts, a number of print cycles, a wear rate for print starts, and a wear rate for print cycles from a memory;

calculating wear of a cleaning blade based on the number of print starts, the number of print cycles, the wear rate for print starts, and the wear rate for print cycles, wherein the wear rate for print starts and the wear rate for print cycles are weighed differently;

determining if the calculated wear of the cleaning blade exceeds a predetermined threshold, wherein if it is determined that the calculated wear of the cleaning blade exceeds a predetermined threshold, sending a notification that the cleaning blade needs to be replaced.

16. The computer-readable medium of claim 15, wherein wear of a cleaning blade is calculated using the formula $Wear=WR_{start}N_{starts}+WR_{run}N_{cycles}$, where $WR_{start}$=blade wear rate of starts, $WR_{run}$=blade wear rate of print cycles, $N_{start}$=number of starts, and $N_{cycles}$=number of print cycles.

17. The computer-readable medium of claim 16, wherein the blade wear rate of starts ($WR_{start}$) is greater than the blade wear rate of print cycles ($WR_{run}$).

18. The computer-readable medium of claim 15, wherein the notification is sent to at least one of a user interface, a computer, a server, a telephone, and a remote maintainer.

19. The computer-readable medium of claim 15, wherein if it is determined that the calculated wear of the cleaning blade exceeds a warning predetermined threshold, sending a warning notification that the cleaning blade needs to be replaced in the near future.

20. The computer-readable medium of claim 15, wherein the cleaning blade is one of a photoreceptor cleaning blade, an intermediate belt cleaning blade, and a solid inkjet drum maintenance blade.

21. The computer-readable medium of claim 15, wherein the image production device is one of a copier, a printer, a facsimile device, and a multi-function device.

* * * * *